US007053746B2

(12) United States Patent
Widiger et al.

(10) Patent No.: US 7,053,746 B2
(45) Date of Patent: May 30, 2006

(54) PENCIL IGNITION COIL

(75) Inventors: Alex William Widiger, Canton, MI (US); Todd Christopher Sexton, Howell, MI (US); William Douglas Walker, Saline, MI (US); Richard William St. John, Ann Arbor, MI (US)

(73) Assignee: Ford Motor Company, Dearborn, MI (US)

( * ) Notice: Subject to any disclaimer, the term of this patent is extended or adjusted under 35 U.S.C. 154(b) by 204 days.

(21) Appl. No.: 10/638,919

(22) Filed: Aug. 11, 2003

(65) Prior Publication Data

US 2005/0035839 A1 Feb. 17, 2005

(51) Int. Cl.
*H01F 27/02* (2006.01)

(52) U.S. Cl. ..... 336/90

(58) Field of Classification Search ..... 336/83, 336/90–96, 192, 198, 219
See application file for complete search history.

(56) References Cited

U.S. PATENT DOCUMENTS 5,285,761 A * 2/1994 Hancock et al. ..... 123/634
5,977,856 A 11/1999 Maekawa et al.
6,191,674 B1 2/2001 Adachi et al.
6,208,231 B1 3/2001 Oosuka et al.
6,332,458 B1 * 12/2001 Shimada et al. ..... 123/634
6,343,595 B1 2/2002 Nakabayashi et al.
6,508,239 B1 1/2003 Shimada et al.
2002/0014940 A1 2/2002 Kondo et al.
2002/0026929 A1 3/2002 Shimada et al.
2002/0046746 A1 4/2002 Nakabayashi et al.
2002/0057170 A1 5/2002 Skinner et al.
2002/0067233 A1 6/2002 Kondo et al.
2002/0175796 A1 11/2002 Kawai et al.

FOREIGN PATENT DOCUMENTS

EP 0 859 383 A3 8/1998
JP 2000-91144 A 3/2000

* cited by examiner

*Primary Examiner*—Tuyen T Nguyen
(74) *Attorney, Agent, or Firm*—Mark S. Sparschu; MacMillian Sobanski Todd

(57) ABSTRACT

A magnetic core assembly for an ignition coil assembly allows unique exterior shapes to be formed by an outer insulation layer, while speeding up the manufacturing process. Generally, the magnetic core assembly comprises a core of ferromagnetic material and an overmold over the exterior of the core. The overmold generally comprises an insulating layer injection molded over the core. Various structures may be incorporated into the core assembly for injection molding, while a second insulative layer provides additional thermal and electrical insulation.

14 Claims, 3 Drawing Sheets

PENCIL IGNITION COIL

FIELD OF THE INVENTION

This invention relates generally to internal combustion engine spark ignition systems, and more particularly relates to individual ignition coil assemblies mounted directly to an internal combustion engine.

BACKGROUND OF THE INVENTION

Known internal combustion engines typically comprise cylinder blocks containing individual cylinders that are closed at one end by an engine cylinder head that is attached to the engine block. In a spark-ignition engine, the cylinder head contains threaded spark plug holes, each of which is open to a respective cylinder. A respective spark plug is threaded into the respective hole to close the hole. Each spark plug includes a central electric terminal that is available for electric connection with a mating terminal of an ignition coil assembly or module.

One general category of ignition coils are individual coils inserted in substantially inside the spark plug insertion hole in the cylinder head of an internal combustion engine. These assemblies have been variously called a pencil coil, a stick coil, a plug hole coil and cigar coil. Generally, such ignition coil assemblies comprise both a wound primary coil and a wound secondary coil concentrically aligned with a ferromagnetic core. Some ignition coil assemblies place the primary coil inside the secondary coil, while others place the secondary coil inside the primary coil, both of which are suitable for use with the present invention.

In operation, an electric current flows through the primary coil creating a large magnetic field. At the proper time in the engine operating cycle for firing a particular spark plug, the electric current is abruptly interrupted, and the rapid change in the magnetic field induces a voltage in the secondary coil sufficiently high to create a spark across gapped electrodes of the spark plug.

Most known pencil coils incorporate electrical, mechanical and thermal isolation between the magnetic core and the closest coil. Typically, the coil is formed on an insulative bobbin, however additional isolation is provided. One known method is the application of heat-shrink tubing around the ferromagnetic core. Another method is a direct casting of rubber or other material inside the bobbin and outside the ferromagnetic core. Unfortunately, both of these methods and their structures have drawbacks.

For example, the bobbin containing the coil typically has a round or cylindrical interior wall. However, the ferromagnetic core may be frustoconical shaped or oval-shaped in its cross-section, and that shape is continued after the plastic sleeve has been heat-shrinked to the ferromagnetic core, resulting in a mis-match of shapes. With direct casting of rubber into the space between the bobbin and ferromagnetic core, the process is very messy. Further, the process of pouring a viscous gel into a tightly constricted space is extremely slow, and also requires significant time and heat for curing. Additionally, this process can result in the trapping of air within the assembly, thereby forming poorly insulated points. In both cases, precise control over the exterior shape of the ferromagnetic core and isolation layer is extremely difficult and potentially expensive.

Accordingly, there exists a need to provide an ignition coil assembly having electrical and thermal isolation between the magnetic core and the bobbin in which the exterior shape is precisely controlled as well as permitting unique and various shapes, while providing a faster, cleaner and more efficient method of manufacturing the ignition coil assembly.

BRIEF SUMMARY OF THE INVENTION

The present invention provides a magnetic core assembly for an ignition coil assembly which allows unique exterior shapes to be formed by an outer insulation layer, while speeding up the manufacturing process. Generally, the magnetic core assembly comprises a core of ferromagnetic material and an overmold over the exterior of the core. The overmold generally comprises an insulating layer that is injection molded over the core. A projection may be formed on the core to define a gripping surface for providing a holding force on the core during injection molding. Thus, the projection extends through the overmold.

Accordingly to more detailed aspects, the projection preferably tapers as the projection extends radially away from the core and defines a gripping surface that is axially facing. Preferably, a plurality of projections are circumferentially spaced about an outer surface of the core. The overmold may include a plurality of depressions for providing radial support to the core during injection molding. Preferably, the plurality of depressions are axially located in the middle of the overmold and at a point of low electric potential. When the core includes a permanent magnet aligned with a steel cylinder, a second plurality of depressions provide radial support to the permanent magnet.

Another embodiment of the invention provides an ignition coil assembly generally comprising a bobbin and a core. The bobbin has a coil wound thereon, while the core assembly includes a magnetic core and a core overmold. A projection extends radially from the magnetic core. The bobbin defines an inner surface having an upper portion and a lower portion. The diameter of the upper portion is larger than the diameter of the lower portion, and the upper portion is sized to receive the projection.

According to more detailed aspects, the projection extends through the core overmold and defines a gripping surface for providing a holding force on the magnetic core during injection molding to form the core overmold. A secondary layer is injection molded between the core assembly and the bobbin. The secondary layer substantially covers the projections and is preferably of an insulative material. When the core overmold includes a plurality of depressions for providing radial support to the core assembly, the secondary layer preferably fills in the plurality of depressions.

A method is provided according to the present invention for manufacturing an ignition coil assembly. The method includes the steps of winding wire around a secondary bobbin and inserting the wound secondary bobbin within a primary bobbin. Wire is then wound around the primary bobbin. A core is overmolded with an insulating layer. The overmolded core is inserted within the secondary bobbin. A final step includes overmolding the core, primary bobbin, and secondary bobbin with a second insulating layer.

BRIEF DESCRIPTION OF THE DRAWINGS

The accompanying drawings incorporated in and forming a part of the specification illustrate several aspects of the present invention, and together with the description serve to explain the principles of the invention. In the drawings.

DETAILED DESCRIPTION OF THE INVENTION

Figure 1:
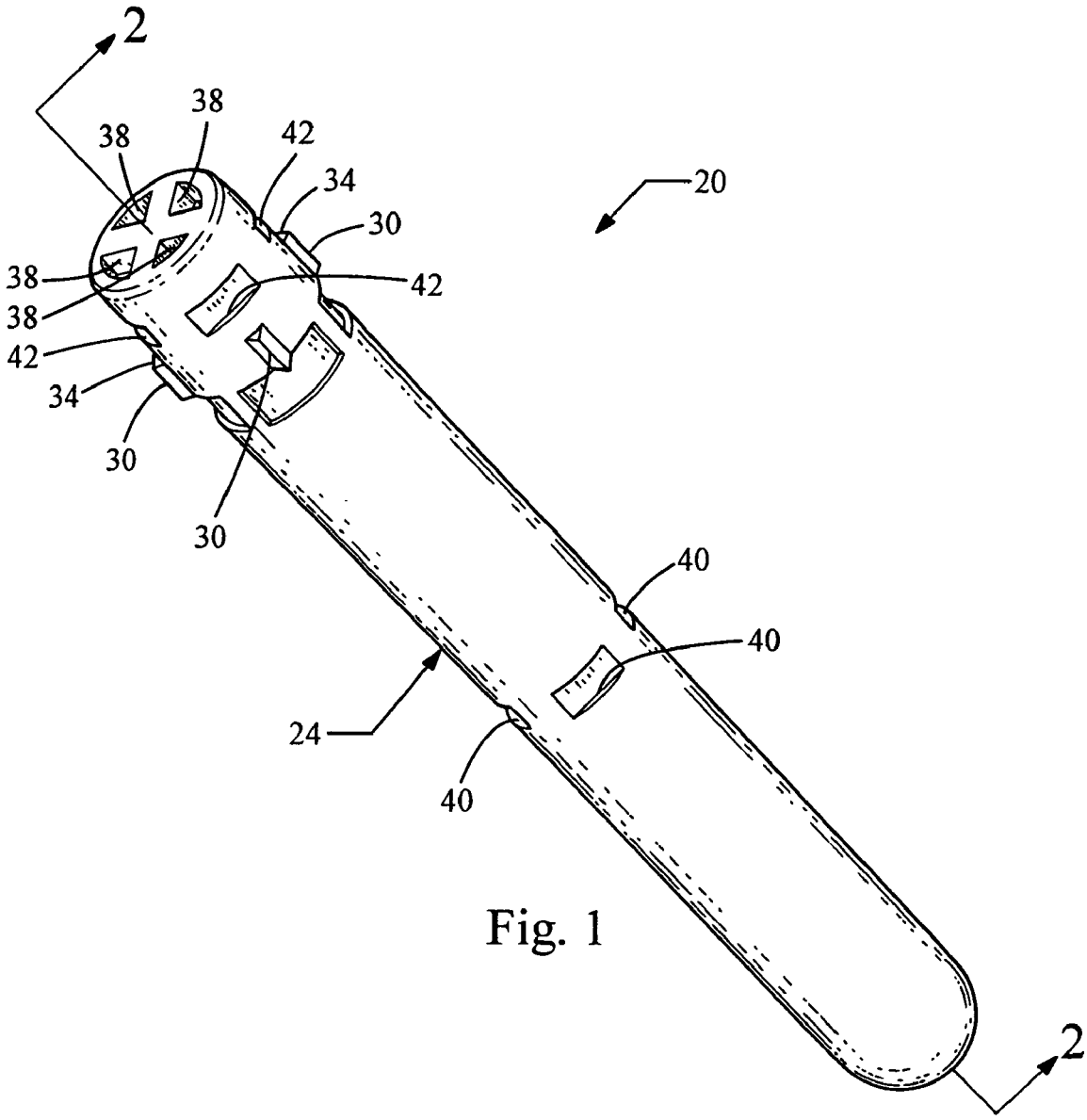
FIG. 1 is a perspective view of an embodiment of the core assembly constructed in accordance with the teachings of the present invention.
Figure 2:
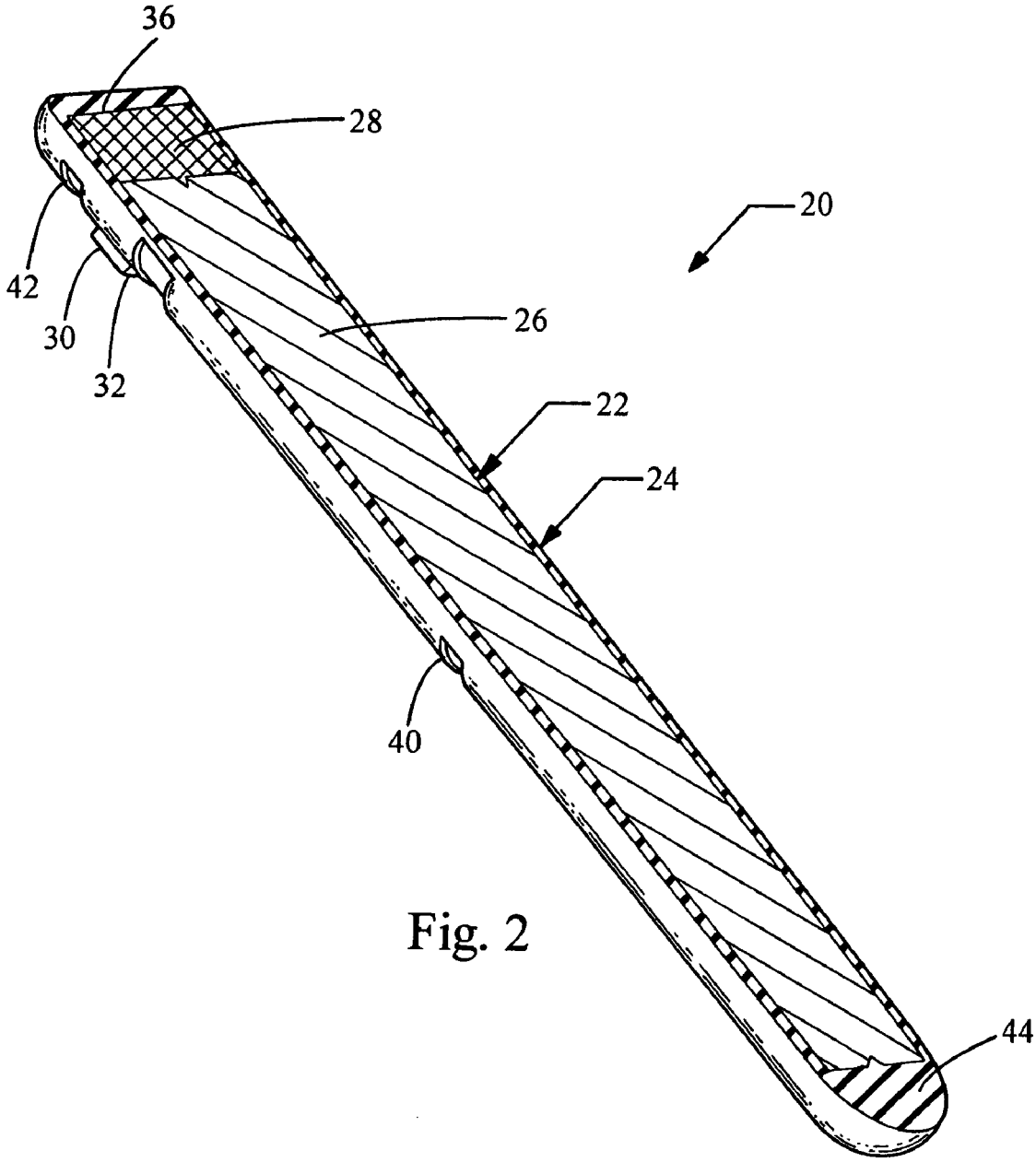
FIG. 2 is a perspective view, partially cut away, showing a cross section of the core assembly depicted in FIG. 1.
Figure 3:
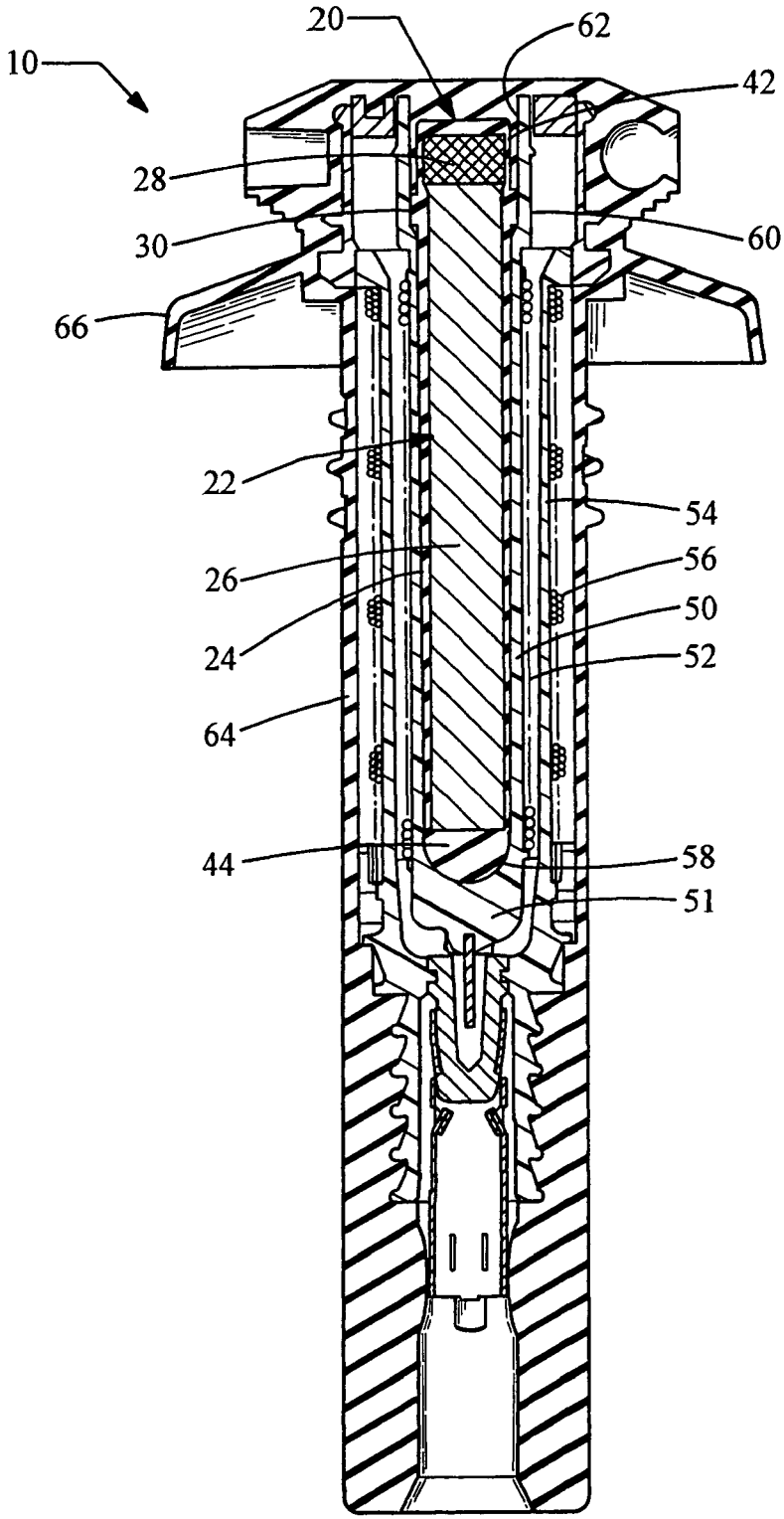
FIG. 3 is a cross-sectional view of an ignition coil having the core assembly depicted in FIGS. 1 and 2.

Turning now to the figures, FIG. 1 depicts a perspective view of a core assembly 20 forming a portion of an ignition coil assembly 10 (FIG. 3). As best seen in FIG. 2, the core assembly 20 generally comprises a magnetic core 22 and a core overmold 24. The magnetic core 22 generally includes a steel cylinder 26 and a permanent magnet cylinder 28. The steel cylinder 26 preferably comprises a magnetic steel laminated stack, but alternatively may comprise a powdered metal core. In the former case, individual ferromagnetic laminations are disposed face-to-face to form a generally cylindrical shape. The steel cylinder 26 preferably has a frustoconical shape, i.e. it tapers slightly as it extends downwardly away from the permanent magnet cylinder 28. The steel cylinder 26 may also take other shapes, such as being oval or oblong in cross-section. The permanent magnetic cylinder 28 is an optional component, and the core assembly 20 and magnetic core 22 could further include a second magnet cylinder located at the opposite end of the steel cylinder 26.

The core overmold 24 generally comprises a layer of insulative material, and preferably a dielectric material. More specifically, the core overmold 24 may comprise an elastomer, the most preferred being a liquid silicone rubber material. Plastics such as thermoplastics may also be utilized as well as other dielectric or insulative materials capable of injection molding.

In accordance with the present invention, the magnetic core 22 is overmolded with the core overmold 24 prior to assembly into the entire ignition coil assembly 10. Accordingly, the magnetic core 22 has been provided with structure to facilitate injection molding to form the overmold 24. More specifically, and as best seen in FIG. 1, the steel cylinder 26 has been provided with a plurality of projections 30. These projections 30 are circumferentially spaced about the outer periphery of the cylinder 26, and extend radially away therefrom. The projection 30 extends through the overmold 24. The projection 30 tapers as a projection extends radially away from the magnetic core 22.

As best seen in FIG. 2, each projection 30 defines a gripping surface 32 which faces axially along the core assembly 20. The gripping surface 32 allows an upward force (towards the top left of FIGS. 1 and 2) to be placed on the magnetic core 22 during injection molding of the overmold 24. The corresponding upper axial surface 34 (FIG. 1) could also be used to provide a downward holding force on the magnetic core 22. However, when the permanent magnetic 28 is employed, a mold detail is utilized having fingers extending downwardly to a top surface 36 of the magnet 28. These fingers leave conduits 38 extending through an upper end of the core overmold 24.

To provide radial support to the magnetic core 22, the mold detail includes "V" block type features which support the magnetic core 22. More specifically, these block features leave a first plurality of depressions 40 at about the middle of the core assembly 20 and magnetic core 22. This middle location is selected because this axial point has the lowest electric potential and can best tolerate a reduced thickness in the overmold 24.

When permanent magnet cylinder 28 is employed, a second plurality of depressions 42 are formed with additional "V" block type features in the mold for providing radial support to the magnet 28.

Turning now to FIG. 3, a cross-sectional view of the ignition coil assembly 10 has been shown. The core assembly 20 is preformed as previously discussed. A secondary bobbin 50 is wound with a secondary coil 52. During assembly, the wound secondary bobbin 50 is inserted inside the primary bobbin 54. A primary bobbin 54 is wound with a primary coil 56, as is known in the art. Once the secondary bobbin 50, wound with coil 52, is inserted inside the primary bobbin 54 and wound with coil 56, the core assembly 20 is inserted inside the secondary bobbin 50. As shown in the figure, a lower end 51 of the secondary bobbin is formed with a semi-spherical seat 58. A lower end 44 of the overmold 24 is formed with a corresponding semi-spherical shape. This structural shape, among other things, promotes proper seating of the core assembly 20.

It can also be seen that an upper portion 60 of the secondary bobbin 50 has an inner surface 62. The upper portion 60 and its inner surface 62 has a diameter sized larger than the diameter of the inner surface of the remaining or lower portion of the secondary bobbin 50. In this way, the upper portion 60 of the secondary bobbin 50 is sized to receive the upper portion of the core assembly 20, including radial extending projections 30.

In a final step of the assembly process, the core assembly 20, primary bobbin 54 and secondary bobbin 50 are overmolded with a second insulating layer. Preferably, the liquid silicone rubber material used for overmold 24 is again utilized to form the secondary insulating layer. The secondary insulating layer forms environmental shield 64 and flange 66, as well as other outer housing features. Notably, the second insulating layer also fills the intersties between the core assembly 20 and the inner surface of the secondary bobbin 50. In this way, the chamber defined by the inner surface 62 of the upper portion 60 of the bobbin is filled, substantially covering the projections 30. Likewise, the first and second plurality of depressions 40, 42 are also filled in with the second insulating layer. Finally, the conduits 38 formed in the upper end of the overmold 24 is also filled with the silicone rubber of the second insulating layer.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. An ignition coil assembly comprising:

a bobbin having a coil wound thereon;

a core assembly comprising a magnetic core and a core overmold;

the core assembly including a plurality of circumferentially-spaced projections extending radially from the magnetic core through the core overmold, the projections defining gripping surfaces for providing a holding force on the magnetic core during injection molding to form the core overmold;

the bobbin defining an inner chamber extending longitudinally from an upper portion of the bobbin to a lower portion of the bobbin, the upper portion having a first diameter and the lower portion having a second diameter, the first diameter of the upper portion being larger than the second diameter of the lower portion, the first diameter sized to receive the projections, and the lower diameter sized to exclude the projections.

2. The ignition coil assembly of claim 1, wherein each projection tapers as the projection extends radially away from the magnetic core.

3. The ignition coil assembly of claim 1, wherein the gripping surfaces are axially facing.

4. The ignition coil assembly of claim 1, further comprising a secondary layer injection molded between the core assembly and bobbin.

5. The ignition coil assembly of claim 4, wherein the secondary layer substantially covers the projections.

6. The ignition coil assembly of claim 4, wherein the secondary layer is of an insulative material.

7. The ignition coil assembly of claim 4, wherein the core overmold defines an axial conduit at an upper end of the core assembly for providing a downward holding force, and wherein the secondary layer fills the conduit.

8. The ignition coil assembly of claim 1, wherein the core overmold includes a first plurality of depressions for providing radial support to the magnetic core during injection molding of the core overmold.

9. The ignition coil assembly of claim 8, wherein the plurality of depressions are axially located in the middle of the core overmold.

10. The ignition coil assembly of claim 8, wherein the plurality of depressions are axially located at a point of low electric potential.

11. The ignition coil assembly of claim 8, wherein the magnetic core includes a permanent magnet aligned with a steel cylinder.

12. The ignition coil assembly of claim 8, wherein the plurality of depressions are filled by a secondary layer injection molded between the core assembly and bobbin.

13. The ignition coil assembly of claim 8, wherein the magnetic core includes a permanent magnet aligned with a steel cylinder, and further comprising a second plurality of depressions, the first plurality of depressions for providing radial support to the steel cylinder, the second plurality of depressions for providing radial support to the permanent magnet.

14. The ignition coil assembly of claim 13, wherein the first and second plurality of depressions are filled by a secondary layer injection molded between the core assembly and bobbin.

* * * * *